United States Patent [19]

Ericsson

[11] 4,154,644

[45] May 15, 1979

[54] PULP WASHER

[75] Inventor: Eric O. Ericsson, Bellingham, Wash.

[73] Assignee: Georgia-Pacific Corporation, Portland, Oreg.

[21] Appl. No.: 881,725

[22] Filed: Feb. 27, 1978

[51] Int. Cl.[2] ..... D21C 9/06

[52] U.S. Cl. ..... 162/60; 8/156; 68/158; 162/217; 162/351; 162/364; 210/77; 210/188; 210/400

[58] Field of Search ..... 162/60, 43, 189, 190, 162/208, 217, 264, 297, 308, 314, 351, 364; 210/77, 97, 188, 400, 406; 68/5 D, 158; 8/149.1, 156; 55/55

[56] References Cited

U.S. PATENT DOCUMENTS

| | | | |
|---|---|---|---|
| 1,648,111 | 11/1927 | Collins | 162/43 X |
| 1,933,609 | 11/1933 | Wagner | 68/158 X |
| 2,073,654 | 3/1937 | Smiley | 162/208 X |
| 2,352,304 | 6/1944 | Young | 210/77 X |
| 2,356,285 | 8/1944 | Street | 162/314 X |
| 2,737,858 | 3/1956 | Simpson | 162/297 |
| 2,983,383 | 5/1961 | Wallace | 210/97 |
| 2,999,785 | 9/1961 | Richter | 162/60 |
| 3,454,970 | 7/1969 | Sutherland | 8/156 |
| 3,938,206 | 2/1976 | Stranger-Johannessen | 68/158 X |
| 4,046,621 | 9/1977 | Sexton | 8/156 X |

*Primary Examiner*—Richard J. Fisher
*Attorney, Agent, or Firm*—Peter P. Chevis

[57] ABSTRACT

A horizontal, Fourdrinier foraminous belt type, countercurrent, high-capacity, cellulose pulp washer is described. The described washer is equipped with a hood positioned over a portion of the belt and over vacuum boxes or receptacles under the upper loop of the belt. The gases and vapors drawn into the vacuum boxes or receptacles with the wash liquid are separated from the liquid in the receptacles and recycled to the hood to control the atmosphere in the hood and maintain the desired pressure differential for operation of the washer.

21 Claims, 7 Drawing Figures

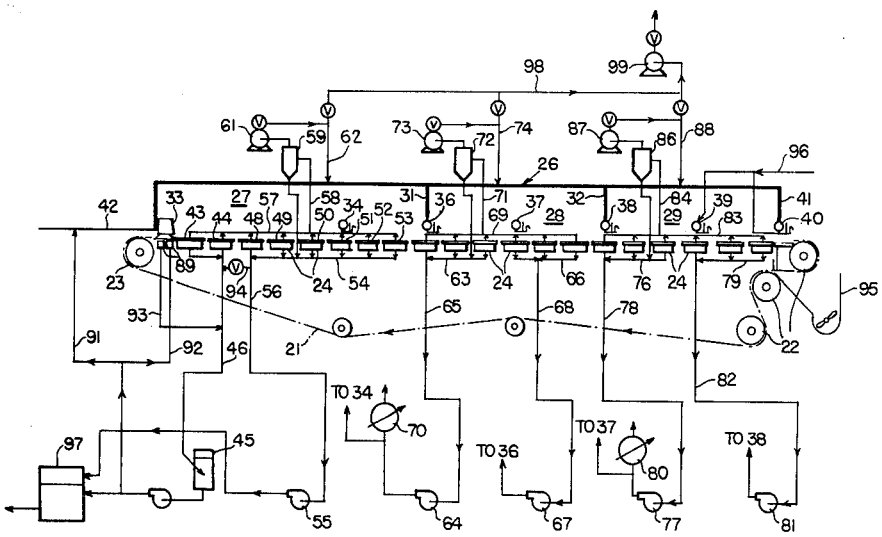

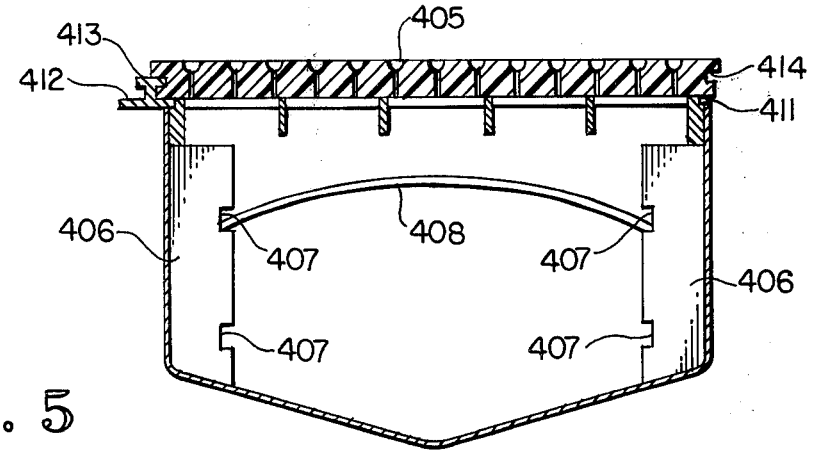
FIG. 5
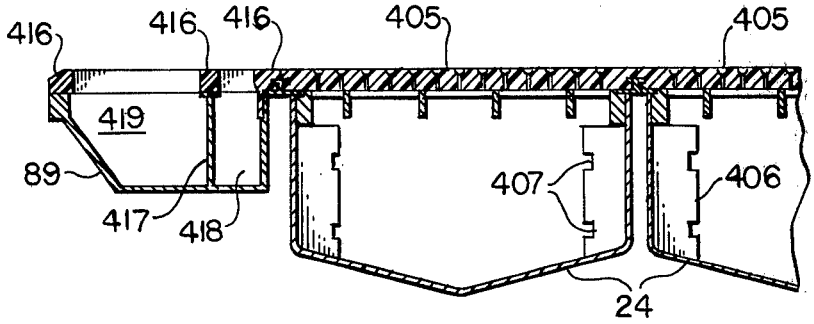
FIG. 6
FIG. 7
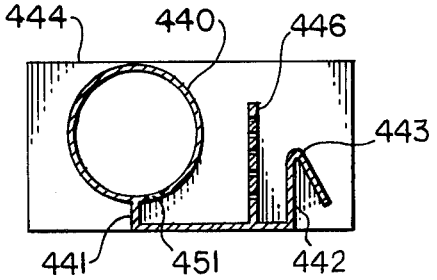

PULP WASHER

This invention pertains to a pulp washer, more particularly to a countercurrent, high-capacity cellulose pulp washer and a process for the use thereof.

In preparation of cellulose pulp, used in the preparation of paper products, wood chips are digested at temperatures above 130° C. with various pulping liquors. In the process, the substances binding cellulose fibers are dissolved in the pulping liquor. The spent pulping liquor, therefore, contains the dissolved wood substances and spent chemicals. It is dark in color and is recovered for processing to recover heat values, cooking chemicals, and/or by-products suitable for sale. The pulp fibers must generally be freed of the spent liquor. It is desirable to recover the spent liquor at as high a concentration of solids as possible since further processing generally involves as a first step the concentration of liquor by evaporation. It is desirable to use a minimum quantity of wash water to achieve a desired washing efficiency because the wash water dilutes the recovered liquor and adds to the cost of evaporation.

In the separation of the spent pulping liquor from the cellulose and in washing of the cellulose, a number of problems are encountered, some of which have been set forth in U.S. Pat. No. 4,046,621. For example, in the kraft and alkali pulping process odoriferous gases and vapors are formed so that upon discharge of the pulping mixture provision for retention of these vapors and gases must be made. In the sulfite pulping process sulfur dioxide is released from the liquor which likewise has to be retained and not discharged into the atmosphere. Hooded vacuum and pressure washers have been disclosed in various patents, for example U.S. Pat. Nos. 1,648,111; 2,352,304; and 3,454,970. Foaming is likewise encountered since the pulping liquors have surfactant properties. The use of mechanical foam breakers and the impingement of high-velocity streams to counteract this problem has been disclosed in U.S. Pat. No. 2,431,009. In addition, scaling may be encountered, especially in the spent calcium sulfite liquor process where calcium sulfate will deposit out. Further, a pulp washer has to operate over a wide range of capacities or loadings which may vary up to 6 fold or more.

Therefore, it is an object of this invention to provide a continuous, variable speed pulp washer effective over a wide range of pulp and water capacities and a process for its operation. A further object is to provide a washer using relatively small amounts of wash water or liquid. A still further object is to provide a washer capable of operation under controlled conditions to minimize vapor escape, foaming and scaling. A still further object is to provide a washer using a multiplicity of flat-top receptacles for withdrawal of the spent liquor and wash water from the pulp wherein a separation between the gases and vapors from the liquid is effected. Still another object is to provide a pulp washer wherein vapors and gases are recycled to control the atmosphere in the washer, minimizing the amount of air drawn into the system, and the amount of gases and vapors discharged from the system. An additional object is to provide a washer characterized by ease of start-up, operation, maintenance, and shut-down.

The above and other objects are attained by this invention by providing a washer comprising a movable substantially horizontal, foraminous belt with means for distribution of a slurry of wood pulp in spent pulping liquor on said belt to form a uniform pulp mat on the moving belt. A plurality of flat-top receptacles communicating with the underside of the belt are positioned horizontally under the upper loop of the foraminous belt. The receptacles form a substantially flat surface under the belt. A hood is placed over the belt and the flat-top receptacles to form a substantially air-tight compartment over a portion of the belt and receptacles. A plurality of liquid discharge boxes are positioned transversally in the hood above the belt to discharge a sheet of liquid on top of the belt or pulp mat on the belt to wash the pulp by passing the liquid through the pulp mat into the receptacles. The vapors and gases drawn into each receptacle with the wash liquid are separated from the liquid in the receptacle with provisions being made to withdraw the vapors and gases from the upper portion and the liquid from the lower portion of the receptacle. The gases and vapors withdrawn from the receptacles may be recycled to the hood compartment to provide the pressure differential between the compartment and the receptacles to force the spent pulping liquor and wash liquid through the pulp mat into the receptacles. Means are provided for the introduction of the fresh washing liquid to one of the discharge boxes and for the conveyance of the wash liquid, after passing through the pulp, from the receptacles progressively to succeeding liquid discharge boxes in the hood to have the pulp mat contacted with the wash liquid a pre-determined number of times. The washer is generally constructed to have at least one end of the receptacles extend transversally beyond the side of the hood from which end the gases and vapors and the liquid are removed. The extension of the receptacles simplifies the construction, operation and maintenance of the washer and also provides additional space and time to enhance the separation of the gases and vapors from the liquid. The washer may be operated under a vacuum or pressure and by recycling the gases and vapors from the receptacles to the hood compartment the composition of the vapors and gases in the hood can be controlled within predetermined limits to have the average gas and liquid phases in the hood substantially in equilibrium thus diminishing heat loss, foaming, scaling and other problems usually encountered. A multi-compartment hood may be used where the advantages are further enhanced by controlling the conditions in each compartment within pre-determined limits.

The invention and the objects will be more fully understood by reference to the following detailed description and accompanying drawings wherein:

FIG. 5 is a cross-sectional view of the flat-top receptacles along the plane illustrated by Line 5—5 of FIG. 4;

FIG. 6 is a cross-sectional view illustrating a coupling or joining the flat-top receptacles to each other as well as a liquid sealing box located at one end of the washer; and FIG. 7 is a cross-sectional view of a discharge box.

Figure 1:
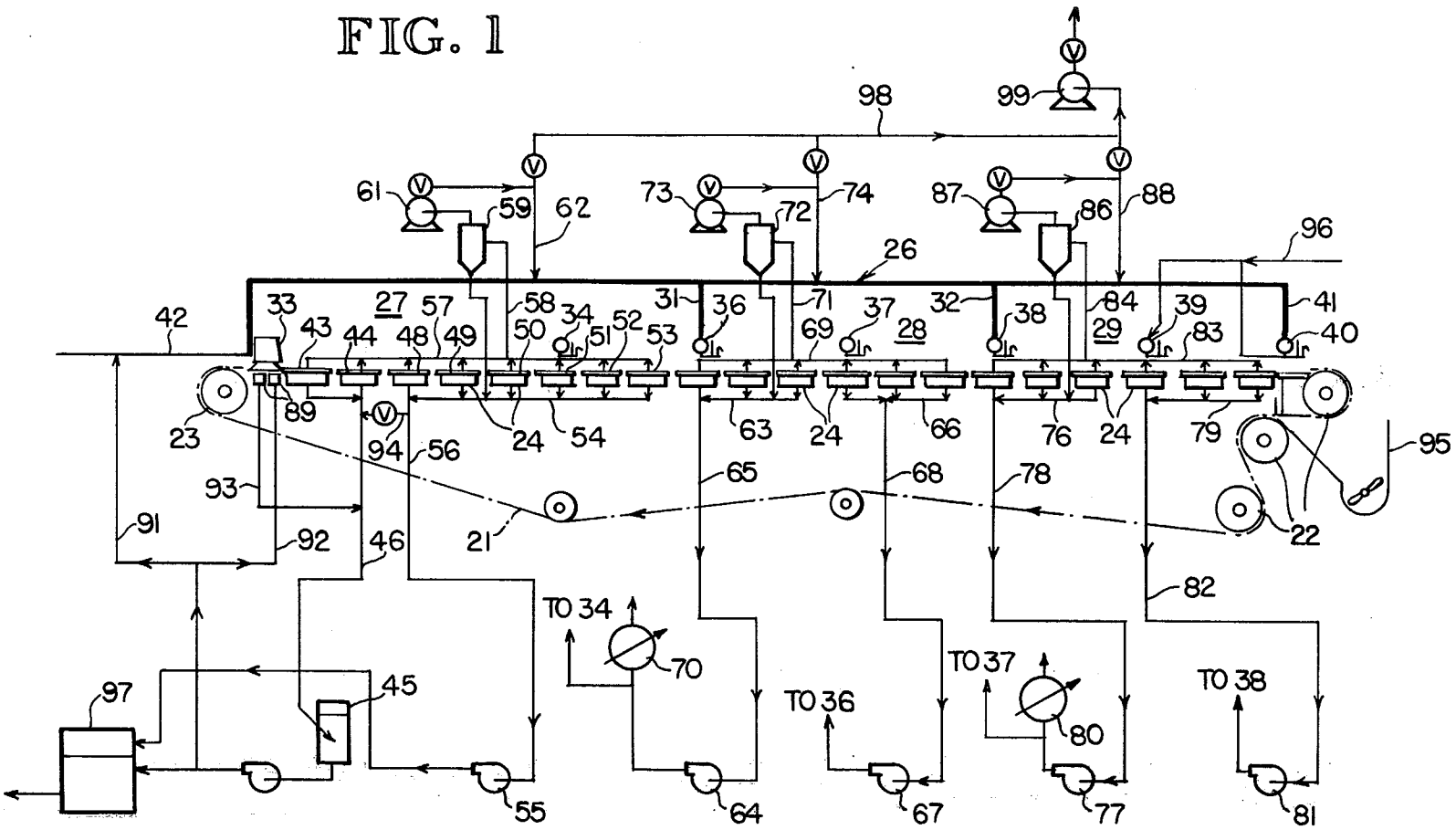
FIG. 1 is a view in side elevation schematically representing an apparatus arrangement in accordance with the invention including heat exchangers for control of the temperature of the washing liquid.

With reference now to the drawings, particularly to FIG. 1, the apparatus comprises a foraminous Belt 21 such as a Fourdrinier wire positioned on Drive Rolls 22 driven by variable speed drive means (not shown), and End Roll 23 to pass over a plurality of flat-top Receptacles 24 covered by a Hood shown generally as 26. The removable hood as shown has three Compartments 27, 28 and 29 formed by Partitions 31 and 32 in the hood. In Compartment 27 are located, above the wire, a Headbox 33 at the entry end of the hood and Discharge Box 34. Discharge Box 36 is located between Compartments 27 and 28 at Partition 31. In Compartment 28, Discharge Box 37 is shown, and Discharge Box 38 is positioned at Partition 32 between Compartments 28 and 29. Discharge Box 39 is located in Compartment 29. Liquid Sealing Box 40 is positioned outside of the hood adjacent to the Discharge End 41 of the hood when it is desirable to reslurry the pulp for further processing. A continuous sheet or curtain of liquid is thus discharged on the belt as it leaves the hood which forms a liquid seal between the belt and Discharge End 41 of the hood. However, if a high consistency pulp was desired, Sealing Box 40 would not be used and other means of sealing would be employed. For example, press rolls could be used which would, in addition to providing the seal, further dewater the pulp.

Eight flat-top receptacles are shown as positioned in Compartment 27 communicating with the compartment. In the compartment, the first two flat-top receptacles, Receptacles 43 and 44, are used for the initial dewatering or removal of spent pulping liquor from the pulp slurry upon the distribution of the slurry upon the wire belt. The spent pulping liquor from these receptacles is collected in Surge Tank 45 through Line 46. The next three receptacles, numbered 48, 49 and 50, are used for the removal of spent pulping liquor, and the remainder three flat-top receptacles, 51, 52, and 53, function in dewatering the pulp of wash liquid discharged from Discharge Box 34. Receptacles 48, 49 and 50, and the three receptacles dewatering the wash liquid discharged by Discharge Box 34 are shown interconnected by Liquid Manifold 54 by each being attached at the bottom to the manifold which is connected to Pump 55 by means of Line 56.

The eight flat-top receptacles communicating with Compartment 27 of the hood are interconnected by a Gas Manifold 57. Manifold 57 is attached to each of the flat-top receptacles at a gas outlet on top of the receptacle permitting the gases and vapors to be drawn from the flat-top receptacles through the manifold into Line 58 and through a gas-liquid Separator 59 for removal of entrained liquid before the gases and vapors enter Blower 61 to be recycled back to Compartment 27 through Line 62.

The gas-liquid separator used may be a cyclone-type separator or any other of various known types used for removal of entrained liquid in gas streams.

In Compartment 28, three flat-top receptacles are used for dewatering of the pulp of wash liquid flooded by each Discharge Box 36 and 37. The flat-top receptacles dewatering the wash liquor coming from Discharge Box 36 are interconnected by Liquid Manifold 63 which is connected to Pump 64 by Line 65. The wash liquid discharged from Discharge Box 37 is dewatered by three receptacles interconnected by Liquid Manifold 66. The liquid manifold is joined to Pump 67 by means of Line 68. The six receptacles communicate with Hood Compartment 28 and are interconnected by Gas Manifold 69 which is coupled by means of Line 71 to Liquid-gas Separator 72 and Blower 73. The vapors and gases from the receptacles are withdrawn from the receptacles by Blower 73 through Line 71 and Separator 72 and recycled back to Compartment 28 through Line 74.

Likewise, in Compartment 29 three receptacles each are used for dewatering the wash liquid discharged from Discharge Boxes 38 and 39. The three receptacles dewatering the wash liquid discharged from Discharge Box 38 are connected to Liquid Manifold 76 which connects to Pump 77 through Line 78, while the wash liquid discharged from Discharge Box 39 is dewatered by three receptacles interconnected by Liquid Manifold 79 which is coupled to Pump 81 by Line 82 and conducted to Discharge Box 38. As in the other compartments, the flat-top receptacles communicating with Compartment 29 are interconnected at the top by Gas Manifold 83 through which the gases and vapors from the six flat-top receptacles may be withdrawn and drawn through Line 84 and Gas-Liquid Separator 86 by Blower 87 before being recycled back to the compartment through Line 88.

Additional equipment shown in FIG. 1 will be specifically noted in the following description of the operation of the washer made in reference to FIG. 1. The operation of the washer is effected by maintaining a pressure differential between the compartment in the hood and the flat-top receptacles communicating with the compartment. Generally the pressure differential is in the range of 1 to 4 inches of mercury resulting in the liquid and the gases and vapors being drawn through the mat at relatively low velocities. In the operation of the washer, the pulp slurry from the digester, containing usually from 1 to 8% pulp in spent pulping liquor, is discharged into Headbox 33 through Line 42. The consistency of the pulp in the digester slurry is generally at a consistency higher than 8% so that the digester slurry may be diluted by addition of spent pulping liquor or mixture of the spent pulping liquor and wash liquid leaving the washer. From the headbox, the slurry is uniformly distributed between the deckles on Belt 21 driven at a speed of from 10 to 300 feet per minute by Drive Rolls 22 and passing over End Roll 23. The wire or belt, after passing over End Roll 23 and before entry into the hood, is passed over a Liquid Flooding Box 89 where the wire is flooded with spent pulping liquor or concentrated wash liquid functioning as an air seal and filling the openings of the belt with the liquor to displace the air. The flooding of the wire and the uniform discharge of the pulp slurry on the wire forms an effective air seal and minimizes the amount of air carried into the hood at the entrance of the wire into the hood. Upon discharge of the slurry upon the moving belt, some pulp fibers pass through the belt until a mat of pulp fibers is formed. Thus, the spent pulping liquor initially obtained containing the limited amount of wood fiber is drawn into Flat-top Receptacles 43 and 44 and into Surge Tank 45 from which generally the liquid may be recycled by being pumped, as shown in the drawing, through Line 91 to be intermixed with the feed slurry and used in the dilution of the digester slurry to obtain the desired consistency for feed to the washer. Likewise, a portion of this spent pulping liquor may be passed through the Liquid Sealing Box 89 by Line 92 with the overflow being returned to Line 46 by Line 93. Additional spent pulping liquor and concentrated wash liquid may be added to Surge Tank 45 from Manifold 54 by means of Line 94 to maintain a sufficient supply of liquor in Surge Tank 45. After the initial recovery of limited amount of spent pulping liquor in Receptacles 43 and 44, the remaining spent pulping liquor is drawn into Flat-top Receptacles 48, 49 and 50 upon passage of the slurry on the wire over the top of these receptacles. After removal of the freely associated spent pulping liquor from the pulp, a mat of pulp from one-half to six inches in thickness is obtained which then passes under Discharge Box 34 whereupon it is flooded with wash liquid and dewatered by passing over the three remaining flat-top receptacles, 51, 52, and 53, in Hood Compartment 27. The pulp thus dewatered of the concentrated wash liquid then passes to Compartment 28 in the hood and is flooded by Discharge Boxes 36 and 37. After each flooding, the pulp is dewatered by passing over three flat-top receptacles. The pulp passing on the wire belt is flooded by Discharge Box 38 upon entering Compartment 29 of the hood where it is dewatered and further flooded by Discharge Box 39 and again dewatered before being flooded by Sealing Box 40 upon exit from the hood. The pulp with the water or liquid from Sealing Box 40 upon leaving the hood is discharged from the belt into Repulper 95 where the pulp is reslurried when a lower consistency is desired for further processing such as screening or bleaching or other use.

The wash liquid used in washing of the pulp may be water or an effluent such as white water from screening operation, bleaching operation, or a paper machine or some other stream available in the pulp and paper mills. As shown in the drawing, the wash liquid is charged to the washer through Line 96 with a portion of the liquid going to Discharge Sealing Box 40 and the remainder to Discharge Box 39. It is not necessary to use wash liquid in Discharge Sealing Box 40 for flooding of the pulp prior to repulping. It may be desirable at times, for example, to use water in Sealing Box 40 for the repulping and use a stream obtained from another part of the pulp or paper mill in Discharge Box 39 for washing or vice versa. Also, Sealing Box 40 may be used to contact the pulp with a particular liquid or solution as a first treatment step for further processing of the pulp, such as for example, bleaching.

The fresh wash liquid, after flooding the pulp by being discharged from Discharge Box 39, passes through the pulp sheet or mat into the flat-top receptacles and is pumped by Pump 81 to Discharge Box 38 through a line not shown in FIG. 1. The wash liquid obtained upon dewatering of the pulp after flooding of the pulp with wash liquid from Discharge Box 38 is passed from the flat-top receptacles to Pump 77 from where it is pumped to Discharge Box 37 in Compartment 28 and thus used to wash the pulp incrementally, countercurrent to the movement of the pulp on the belt. In like manner, the wash liquid recovered upon dewatering of the pulp after flooding with the wash liquid from Discharge Box 37 is pumped to Discharge Box 36 and upon dewatering of the pulp after flooding from Discharge Box 36 the wash liquid is discharged to Discharge Box 34 where it is used as the first wash for pulp from which the freely associated spent pulping liquor has been removed. The concentrated wash liquid obtained upon dewatering of the pulp mat flooded by Discharge Box 34 and the spent pulping liquor, as shown, discharge to Pump 55 and Tank 97 for storage prior to further processing. At times it may be desirable to keep the concentrated wash liquor separate from the spent pulping liquor, in which event the spent pulping liquor from Flat-top Receptacles 48, 49 and 50 would be discharged to Washer Recovery Tank 97, and the concentrated wash liquor from Receptacles 51, 52 and 53 would be pumped elsewhere for storage.

While the wash liquid obtained upon dewatering of the pulp after each flooding may be passed through a heat exchanger to heat or cool the liquid as desired before passing the liquid to the next proceeding discharge box, generally it may be desirable only to control the temperature of the wash liquid entering a particular compartment. Thus, the wash liquids coming from Pumps 64 and 77 are only shown in FIG. 1 as being heat exchanged in Heat Exchangers 70 and 80, respectively, prior to introduction of these wash liquids to the next compartment. Any heating or cooling medium may be used in the heat exchangers as desired; however, generally if used the wash liquid is heat exchanged against another washer stream.

In addition to controlling the temperature of the wash liquid, the atmosphere within each of the compartments is controlled by using Blowers 61, 73 and 87 to withdraw the gases and vapors from the top of the flat-top receptacles communicating with the particular compartment of the hood and recycling these vapors and gases back to the compartment. The pressure within each compartment of the hood may be controlled directly, if desired, by venting the discharge from the respective blower into Line 98, or the pressure in one compartment may be controlled and the pressure in the other compartments permitted to establish their own levels close to the controlled pressure by normal leakage or by using pressure controlled vents in the partitions between the compartments. The gases and vapors which are vented are passed to other processing units by means of Blower 99. By controlling the pressure and by recycling the vapors and gases within each compartment of the hood, a relatively constant atmosphere within each compartment is established which is substantially in equilibrium with the liquid within the compartment.

Figure 2:
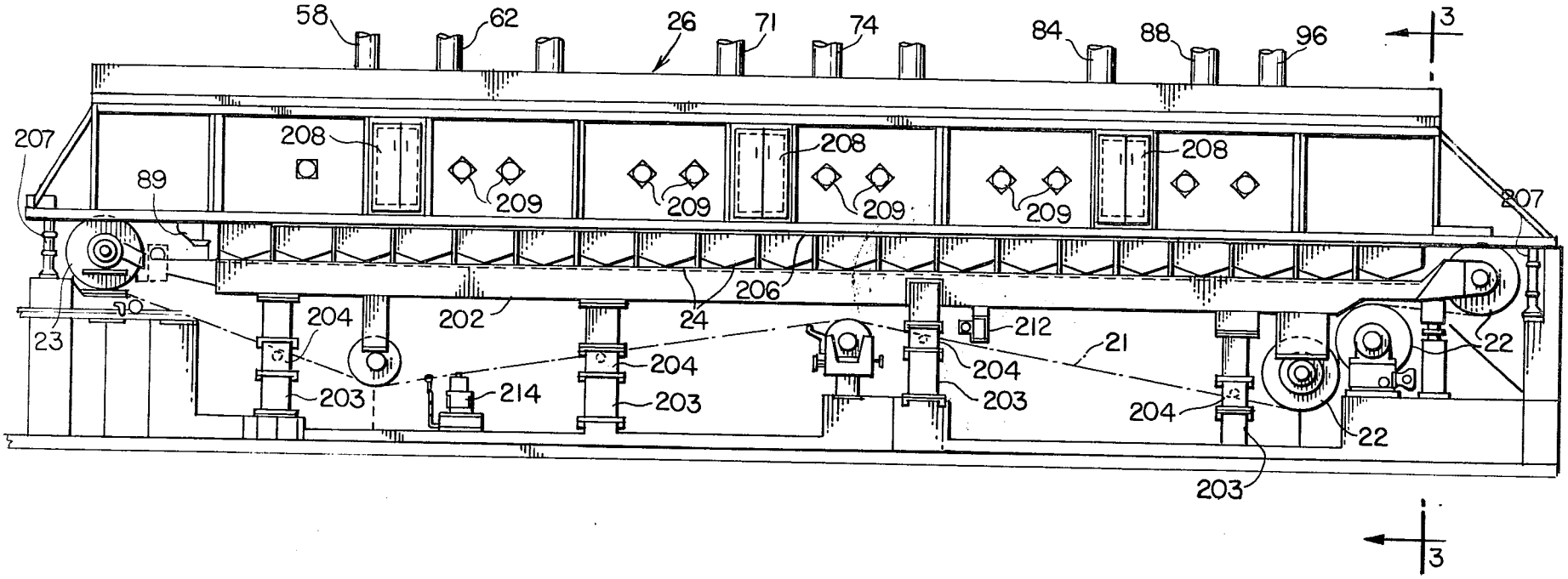
FIG. 2 is the side elevation of a pulp washer in accordance with the invention.

Further details with respect to the washer and its operation will be apparent from the discussion of the washer with respect to the other drawings. The side elevation of the washer as shown in FIG. 2 illustrates the structure and assembly of the various units making up the washer. One of the main structural members of the washer is Beam 202 which rests upon two end pillars and Center Supports 203. Center Supports 203 are provided with a Removal Section 204 which may be removed for the installation or removal of Belt 21, when the belt is not a "pin-seam" wire. The Flat-top Receptacles 24 are positioned in close proximity to each other and are supported by Beam 202. The side structural Bottom Member 206 of Hood 26 rests upon the top surface of the flat-top receptacles which provides the support for the hood. Jacks 207 at the ends of the hood are used to provide a means to raise the hood when the installation or replacement of the mesh belt or Fourdrinier wire is required. Doors 208 are provided in the sides of the hood for entry into the compartments within the hood. Side View Glasses 209 are also provided so that the operations in the compartments may be viewed from the outside. The wash liquid pipelines are shown entering the hood from the top which are connected to the discharge boxes in the hood enclosure. Gas lines for discharging the recycled gases and vapors into the hood compartments are also shown. A Belt Washer 212, which may be an oscillating high-pressure water spray, is used to clean the belt or wire as the belt passes underneath the flat-top receptacles and Supporting Beam 202 before passing under the headbox for distribution of additional slurry. The washer removes pulp fibers which may be adhering to the wire, and the washer fluid may likewise contain the proper solvent or detergent for the removal of any pitch which may be deposited upon the wire. After washing the belt or wire, the wire is passed over a Dryer 214 which may be an air stream or other means, such as, for example, a vacuum box, for the removal of the major portion of the water which may be adhering to the wire. While the presence of water may not have any detrimental effect on the operation, it contributes to the dilution of the pulping liquors obtained which then has to be removed by evaporation in processing the wash liquid and spent pulping liquor.

Figure 3:
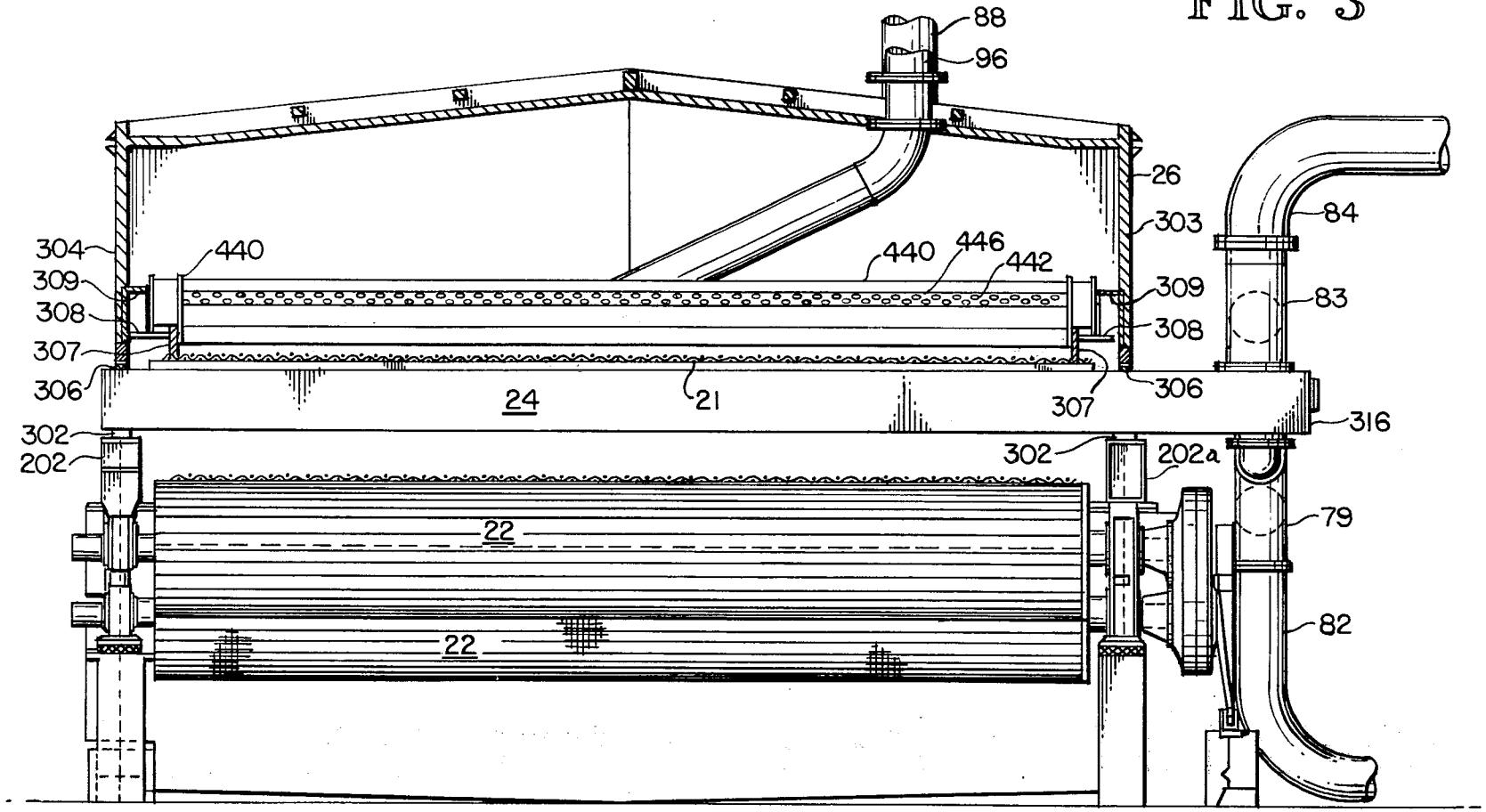
FIG. 3 is a cross-sectional, end view of the washer taken along plane shown by Line 3—3 in FIG. 2.

FIG. 3, which is a cross-sectional end view of the washer, illustrates the relationship of the hood to the Flat-top Receptacles 24. The flat-top receptacles are positioned upon Beam 202 and Beam 202*a* by Support 302. The flat-top receptacles, as shown, extend beyond the width of the hood to have the Sides of the Hood, 303 and 304, rest upon the top surface of the receptacles. A Gasket 306 is generally placed between the hood and the top surface of the flat-top receptacles to form a seal between the hood and the receptacles. The gasket is usually of a resilient material so that the weight of the hood is sufficient to deform the gasket to form a substantially air-tight seal without having to bolt the hood down. Extending inward from the sides of the hood are Vertical Plates 307 which are supported from the sides of the hood by Brackets 308. The vertical plates form the deckle which confines the pulp on the belt or wire surface. These plates are generally of resistant metal to which may be attached a resilient strip of polymeric material which comes in contact with the Belt 21. Discharge Box 39 is attached to and supported by the sides of the hood by Flanges 309.

By extending the length of the flat-top receptacles a sufficient distance beyond the width of the hood, the hood may be positioned or seated on top of the flat-top receptacles which simplifies the fabrication and installation and permits easy removal of the receptacles for maintenance. While the flat-top receptacles may be shortened, and the hood may be positioned and supported directly by Beams 202 and 202*a* or by some other support means, with provisions being made to provide a seal between the hood and the top of the receptacles, fabrication and maintenance would be more involved. Generally, the flat-top receptacles are not only extended a sufficient distance beyond the width of the wire or belt to support the hood, but one end of the receptacle, End 316 as shown, is extended still further. Since the separation between the gaseous constituents and the liquid will be substantially effected within the receptacles, the extension of the receptacles provides additional surface area and time for the separation of the gaseous constituents from the liquid before their removal from the receptacles. Thus, the receptacles may be extended as far as necessary for control of foaming. For practical reasons, the extension is generally limited to about 50% of the distance between the deckle or width of the belt or wire. Even though there may not be any need for the extension of the receptacles to provide additional space and time for separation of the gases and vapors from the liquid, End 316 is extended a sufficient distance, which is usually at least 2 to 4 feet, from the Side 303 of the hood to have the piping and manifolding for the vapor and gas and the liquid removals a sufficient distance from the other parts of the washer to simplify the construction and maintenance. By having the gas and vapor and liquid outlets at a distance from the main body of the washer, the receptacles may be interconnected by ordinary piping and pipe fittings to form the headers or manifolds for the removal of the gases and vapors from the top or upper portion of the receptacles and liquid from the bottom or lower portion without interfering with other parts of the washer or having to fabricate special headers. Additional space and time for separating of the gaseous constituents from the liquid could be provided in the special headers, but the fabrication of the receptacles with such headers would usually be more costly than just extending the flat-top receptacles as shown in the drawing.

Figure 4:
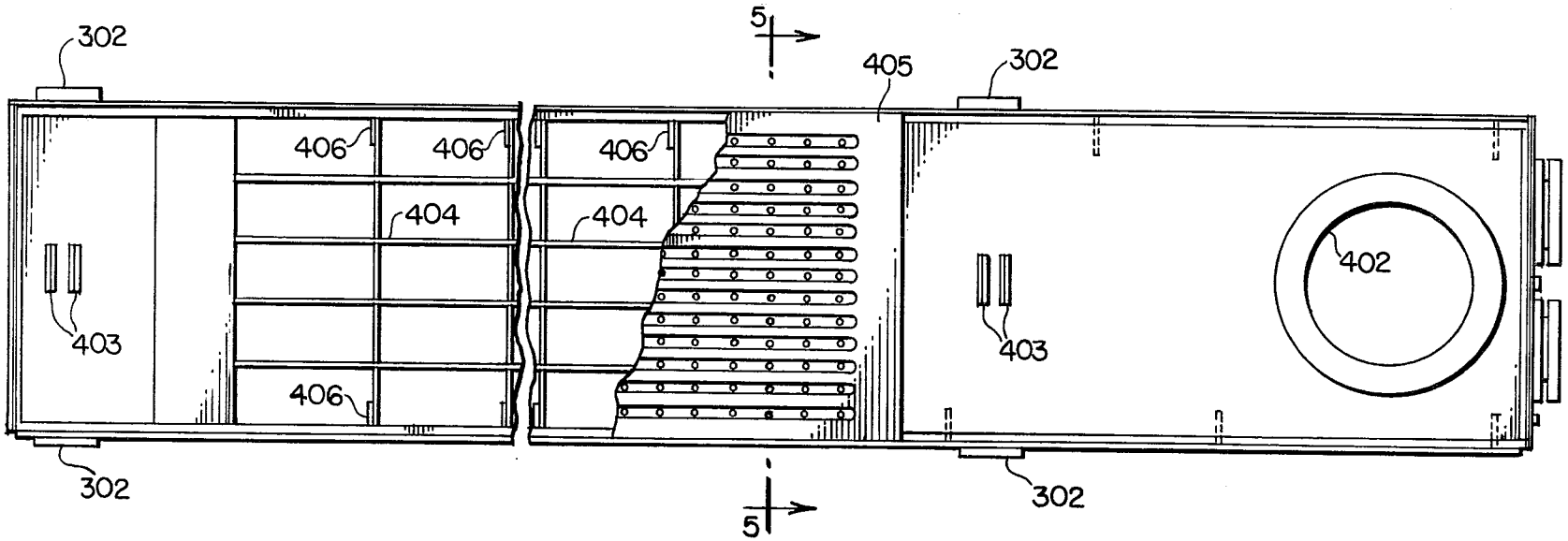
FIG. 4 is a top view of the flat-top receptacles used in the washer.

Details of the Flat-top Receptacles 24 are more apparent from FIGS. 4 and 5 which show a top view and a cross-section of the receptacles. In the top view, FIG. 4, a Gas Outlet 402 is shown at one end of the receptacle. Lugs 403 are attached to the top surface of the flat-top receptacles which function as guides in placing the hood upon the top of the receptacles. The lugs engage the sides of the hood allowing it to settle a fixed amount to contact the gasket and also help to maintain the gasket used for sealing between the flat-top receptacles and the hood in place. The top portion of the receptacle corresponding to the width of the wire belt is substantially opened at the top except for a Metal Grid 404 made of metal bars to provide support for a Slotted Cover 405 which is generally, for example, a plastic or ceramic material which has a low coefficient of friction to the wire which passes over the top of the receptacles. The Support 302 which positions the receptacles on the Support Beam 202 is shown as extending up the sides of the receptacle and thus aid in supporting the hood of the washer. Obviously, the receptacles could be constructed to bear the weight of the hood or separate brackets or other means used to support the hood as long as a seal is provided between the hood and the top of the receptacles. Inside of the receptacles there are Vertical Flanges 406 extending inwardly from the sides which are shown in more detail in FIG. 5. As noted in FIG. 5, the flanges are notched with Openings 407 to permit, if needed, the installation of Baffles 408 if highly foaming conditions are encountered. The baffles may be installed in some of the receptacles only below the opened-top areas of the receptacles or only at the discharge end of the receptacles between the gas outlet and liquid outlet in receptacles which may have higher flow rates of vapors and gases.

Since the separation between the liquid and the vapors and gases is made in the receptacles, the receptacles are of a greater depth than the vacuum boxes or pans commonly used with washers or Fourdrinier paper machines. In the latter, the liquid and vapors and gases are drawn through the vacuum pan and through a pipe or conduit into evacuated separation tanks where the separation between the liquid and the vapors and gases is made. In this regard, the vacuum pans or boxes merely function as the end of the conduit, enlarged to cover a larger area. In effecting the separation between the liquid and vapors and gases in the receptacle, liquid is retained in the receptacle with the level of the liquid in the receptacle being controlled to decrease the distance that liquid being drawn into the receptacle must fall before hitting the body of the liquid in the receptacle while still providing sufficient vapor and gas space in the receptacle to have acceptable velocities of the gaseous materials in the receptacle, for example not exceeding about 20 feet per second, to avoid excessive turbulence. While the liquid level maintained in the receptacles depends to a certain extent upon the loading of the vapors and gases in the washer, generally the liquid level in the receptacles is controlled such that the distance that the liquid falls is in the range of 4 to 15 inches near the entrance end of the washer and not exceeding about 24 inches at the discharge portion of the washer. The velocity of the gases and vapors in the receptacles is generally in the range of about 5 to 15 feet per second and may be 1 foot per second or lower under desired conditions when substantially only liquid is drawn into the receptacles. The liquid velocities are generally less than about 5 feet per second and most often less than about 2 feet per second. In operation of the washer under reduced capacity, lower liquid levels may be maintained, as more gases and vapors may be drawn into the receptacles increasing the gas loadings. The relatively small liquid drop or fall in the receptacles and the relatively low velocities at which the liquid and the vapors and gases are drawn through the pulp mat or sheet and moved in the receptacles minimize foam generation. The above, combined with a large surface area as provided in the receptacles for foam dissipation or separation of the gases and vapors from the liquid, eliminates foaming to the extent that the washer may be operated washing sulfite pulp without the use of any antifoaming agents or devices. Further, in providing for the liquid level control in the receptacles, generally sufficient liquid is retained within the receptacles to handle the normal liquid flow variation obtained in operation of the washer without the need of surge tanks.

As shown in FIG. 6, the Flat-top Receptacles 24 are assembled by being joined at the top to form a substantially flat air-tight surface at the top at least over the portion of the receptacles covered by the hood. A convenient method of joining the receptacles as noted in FIG. 5 is to have the edges of the receptacles at the top recessed to form a Groove 411 into which a flat plate may be placed which then will be level with the top surface of the box and the metal grid. The flat plate may be removably attached to the two adjacent receptacles such as by screws or other means. Over portions of the receptacle which are covered by plastic Cover 405, an I Beam-type Member 412 may be used instead of the flat plate. The Top Edge 413 of the I Beam 412 engages Groove 414 in the plastic cover. FIG. 6 shows a cross-sectional view of the Liquid Sealing Box 89 which likewise has a Cover 416 of plastic or other material of low coefficient of friction on top of the Sealing Box 89 and on Partition 417 of Sealing Box 89. In operation of the sealing box, spent pulping liquor is introduced into Chamber 418 to a level such that the spent pulping liquor will overflow Partition 417 and Cover 416 on top of Partition 417 into Chamber 419 from which it will be drained and recycled through Line 93 (not shown on FIG. 6). The wire passing over the Chamber 418 thus is flooded with spent pulping liquor removing the air from the wire entering the hood enclosure and also functioning as an air seal.

Discharge boxes of various designs may be used as long as the required large amount of the wash liquid can be uniformly distributed with only a limited disturbance to the pulp mat. A cross-sectional view of a weir-type discharge box of a particular design is shown in FIG. 7. The discharge box is an open-top trough with a wash liquid Pipe 440 being attached to the bottom plate of the trough by Web 441 to have the wash liquid pipe with the web serve as a high side of the trough. The overflow side of the trough, Side 442, is rounded at the top and extends downwardly to form a rounded Weir 443 at the top over which the wash liquid flows. The side, web, and the wash liquid pipe are attached to Flat End Plates 444 forming the ends of the trough of a given length to be positioned in the hood between the deckles. A perforated Plate 446 is attached to the bottom plate of the trough between the overflow side and Pipe 440 to stabilize the flow of the wash liquid. The wash liquid enters the trough from Pipe 440 by being discharged from the pipe into the trough through a multiplicity of Metering Holes 451 in Pipe 440 located in the lower section of the pipe. The wash liquid discharged from the metering holes fills the trough and overflows over the rounded Weir 443. As shown in FIG. 3, the discharge box is supported in the hood by Flanges 309. The number of discharge boxes used may be varied depending upon the number of flooding or contact stages desired. With large flooding rates, modified discharge boxes using two overflow weirs, one on each side of the wash liquid Pipe 440, may be used. The boxes may be movably positioned in the hood and a discharge box may be located at the compartment partitions. The overflow from the discharge box at the partition may function as a seal between the compartments, when the compartments are operating at substantially the same pressure.

A plurality of individual receptacles are shown being used in the removal of spent pulping liquor from the pulp and in dewatering the pulp after flooding of the pulp with wash liquid for each discharge box. By using a plurality of individual receptacles for each discharge box, the individual receptacles are smaller and, thus, more convenient to manufacture and handle, especially for large capacity washers. Receptacles of one size may be manufactured and these may be used singly or grouped together in twos, threes, fours or more for each discharge box to obtain the dewatering desired. The ratio of vapors and gases to liquid drawn into the respective receptacles may vary. Ideally, only wash liquid should be drawn through the pulp mat into the receptacles. For most efficient operation, the speed of the belt and the pressure differential between the hood compartments and the receptacles should be adjusted in relation to the amount of wash liquid used for proper washing to obtain a pulp mat of a thickness and uniformity such that the free wash liquid on the top of the mat after flooding is removed forming a "dry line" just before being flooded again with wash liquid from the next discharge box. This, however, is difficult to maintain especially under the varying conditions the washer is operated. As a result, the receptacles closest to the discharge boxes or flooding may have wash liquid mainly drawn into the box, while the receptacle the greatest distance from the discharge box at times may draw in more gases and vapors.

It is not necessary to maintain the same pressure differential for each flat-top receptacle communicating with a particular compartment. While not shown in the drawings, pressure control valves may be installed in the gas lines from the receptacles leading to the gas manifold lines so that the differential pressure applied to particular flat-top receptacles may be varied as desired and by this means regulate to a certain extent the amount of materials drawn into each receptacle. In Compartment 27, for example, it may be desirable under certain conditions to maintain a greater differential pressure between the hood and the receptacles recovering the wash liquid, Receptacles 51, 52, and 53, than for the other receptacles communicating with the compartment recovering the spent pulping liquor, which may be accomplished by installation of pressure control valves (not shown) in the proper positions in the Gas Manifold 57 or in the gas and vapor lines from the receptacles communicating with Gas Manifold 57.

It is obvious that various changes may be made to the washer without departing from the invention. For example, while more than one individual receptacle is used for dewatering wash liquid flooded from a discharge box, it is not necessary to just use three same-sized flat-top receptacles as shown in the drawing for dewatering of the pulp flooded by a discharge box. One, two, four or more same-sized or different-sized receptacles may be used if desired, depending upon the amount of wash liquid used, rate of flow, and thickness of the pulp mat on the wire or belt. Obviously, the receptacles do not have to be manufactured in single units, but may be constructed in units or assemblies of more than one or obtained by partitioning of one large container or unit. Also, the flooding rates used for different discharge boxes as well as the size and number of receptacles used for dewatering of the wash liquid discharged from different discharge boxes may be varied. For example, a given amount of fresh wash liquid may be used for the last washing stage and then one or more effluent streams from other pulp or paper mill processing units used for other stages, or these streams may be used as additional wash liquid by combining these streams with the wash liquid from the last stage for the other stages. While five washing stages are shown as being used in the washer, the number of stages can be varied as desired from a single stage using one or more discharge boxes, up to six, eight or more stages.

Likewise, it is not necessary to have a hood with three compartments as shown. A multi-compartment hood has particular merit in sulfite process washing to stepwise control sulfur dioxide and water vapor concentrations. In an alkali or sulfate pulping process, a single compartment hood may be sufficient to provide the desired control of the atmosphere in the hood. Under particular circumstances, two compartments may be sufficient for sulfite process pulp washing, and at times it may be desirable to have four or more compartments. The main advantage of the multi-compartment hood is that in each of the compartments an average gas phase-liquid phase equilibrium may be established within pre-determined limits so as to diminish heat loss, foaming, scaling and other problems usually encountered. In a single compartment washer for sulfite pulp, for example, heat and sulfur dioxide would be contained in the pulp discharged from the washer. Also, the hood does not have to cover all of the washing stages. The last washing stage or the stage where the pulp is contacted with the fresh wash liquid may be outside of the hood using a separate blower to obtain the necessary vacuum in the receptacles for this stage. The latter arrangement may be conveniently used where the latter stages of washing are combined with a fiber recovery operation from effluent streams such as white water from the screening room or other streams from a paper mill containing small amounts of dispersed fiber which must be recovered prior to disposal or further use. These streams may be passed through the pulp mat to recover the fiber and thus used to wash the pulp with or without additional washing or rinsing of the pulp. After recovery of the fiber, a portion of the filtered streams may be conveyed, if desired, to the succeeding discharge boxes in the hood to use the liquid by itself or combined with additional wash liquid for use in the proceeding washing stages.

While the foraminous belt is referred to at times herein as Fourdrinier wire, or wire, as commonly called in industry, it is obvious the foraminous belt does not have to be made of metallic wire but may be made of various materials, usually of a polymeric material.

As noted above, the washer may be operated under increased pressure or reduced pressure, as desired, with the pressure in the individual hood compartments differing or being the same. High pressure may be used in compartments operating at high temperatures, or the pressures may be controlled in one compartment and the pressure in the other compartments allowed to adjust. By recycling the gases and vapors to each compartment, a substantially constant atmosphere in each compartment of the hood is obtained. The gases and vapors in each compartment approach or become relatively in equilibrium with the liquid within the hood. This is believed to minimize or eliminate scaling and other problems encountered, and suppresses the evaporation and stripping of particular constituents from the wash liquid or pulping liquor, such as, for example, sulfur dioxide from spent sulfite liquor.

The sealing of the compartments with respect to the moving belt and the pulp mat upon the belt may be simply obtained by use of a flowing liquid curtain when the pressures in all of the compartments are about the same or do not vary substantially. Upon entry of the belt into Compartment 27, the discharge of slurry upon the belt provides a flowing curtain or sheet of spent pulping liquor which functions as a seal. In a similar manner the seal between the moving mat and the compartment partitions are obtained by having one of the discharge boxes located at the compartment wall and having the curtain of wash liquid being discharged upon the pulp mat to serve as the seal. This method is also used to provide a seal at the exit from the hood of pulp moving on the wire belt. Other more positive methods of sealing may also be used and may be desirable if substantial pressure differentials were maintained between the hood and the atmosphere or between the compartments. For example, sealing rollers may be used or a flexible polymeric material may be placed at the partitions and at the exit and entrance to have the material contact the surface of the pulp mat. By placing the flexible polymeric material in the higher pressured compartment or pressure side, the pressure differential aids in keeping the material in contact with the top of the pulp mat.

It is not essential that air-tight seals be provided between the compartments in the hood or from the exterior, especially when the hood is operated at slightly below atmosphere pressure so no undesirable gases or vapors can escape into the atmosphere. Some flow between the compartments and from the atmosphere into the hood may be permitted, since a large amount of gases and vapors are recycled in the hood. Usually a portion of the gas and vapor is vented from the recycle stream so that a substantially constant atmosphere may be maintained within each compartment of the hood without difficulty with appreciable amount of in or out flow.

What is claimed is:

1. A wood pulp washer comprising a movable foraminous belt positioned on a series of rolls including a drive roll and an end roll with at least a portion of the upper loop of the foraminous belt being substantially horizontally disposed, means to drive the drive roll to move the belt in a particular direction at variable speeds, a headbox positioned over the belt at one end to distribute a slurry of wood pulp in spent pulping liquor on said moving foraminous belt, a removable hood positioned over a portion of the upper loop of the belt, a plurality of flat-top receptacles positioned horizontally under the portion of the upper loop of the foraminous belt covered by the hood, said receptacles being of a length exceeding the width of the belt with at least one end of said receptacles extending beyond the width of the hood, said receptacles being positioned adjacent to each other to provide a substantially flat surface under said belt with a substantially air-tight seal between the receptacles at the top, said receptacles having openings at the top communicating with the underside of the belt, said hood being positioned above the flat-top receptacles to form a substantially air-tight compartment over the portion of the belt and the flat-top receptacles, a plurality of wash liquid discharge means positioned above the belt transversally to the direction of the movement of the belt in the hood and spaced apart from each other to discharge wash liquid on top of the pulp on the belt, means to introduce wash liquid into the discharge means, means to withdraw gases and vapors from the upper portion of the end of the flat-top receptacles extending beyond the side of the hood, means to provide a sufficient pressure differential between the compartment of the hood and the flat-top receptacles to force the spent pulping liquid from the pulp slurry and the wash liquid discharged on the pulp into the receptacles, means to withdraw liquid from the lower portion of the end of the receptacles extending beyond the side of the hood to control the liquid level in the receptacles, and means to convey the wash liquid withdrawn from the receptacles progressively to the liquid discharge means in the hood to discharge the wash liquid successively on the pulp a plurality of times.

2. A wood pulp washer comprising a movable foraminous belt positioned on a series of rolls including a drive roll and and end roll with at least a portion of the upper loop of the foraminous belt being substantially horizontally disposed, means to drive the drive roll to move the belt in a particular direction at variable speeds, a headbox positioned over the belt at one end to distribute a slurry of wood pulp in spent pulping liquor on said moving formainous belt, a removable hood positioned over a portion of the upper loop of the belt, a plurality of flat-top receptacles positioned horizontally under the portion of the upper loop of the foraminous belt covered by the hood, said receptacles being of a length exceeding the width of the belt and hood, said receptacles being positioned adjacent to each other to provide a substantially flat surface under said belt with a substantially air-tight seal between the receptacles at the top, said receptacles having openings at the top communicating with the underside of the belt, said hood being positioned on the flat-top receptacles with the sides of the hood forming a substantially air-tight seal with the flat-top receptacles to form a compartment over the portion of the belt and the flat-top receptacles, means to restrict the passageways between the belt and the hood at the entrance of the belt to the hood and at the exit from the hood, a plurality of wash liquid discharge means positioned above the belt transversally to the direction of the movememnt of the belt in the hood and spaced apart from each other to discharge wash liquid on top of the pulp on the belt, means to introduce wash liquid into the discharge means, means to withdraw gases and vapors from the upper portion of the flat-top receptacles, means to provide a sufficient pressure differential between the compartment of the hood and the flat-top receptacles to force the spent pulping liquid from the pulp slurry and the wash liquid discharged on the pulp into the receptacles, means to withdraw liquid from the lower portion of the receptacles to control the liquid level in the receptacles, and means to convey the wash liquid withdrawn from the receptacles progressively to the liquid discharge means in the hood to discharge the wash liquid successively on the pulp a plurality of times.

3. A wood pulp washer comprising a movable foraminous belt positioned on a series of rolls including a drive roll and an end roll with at least a portion of the upper loop of the foraminous belt being substantially horizontally disposed, means to drive the drive roll to the belt in a particular direction at variable speeds, a headbox positioned over the belt at one end to distribute a slurry of wood pulp in spent pulping liquor on said moving foraminous belt, a removable hood positioned over a portion of the upper loop of the belt, a plurality of flat-top receptacles positioned horizontally under the portion of the upper loop of the foraminous belt covered by the hood, said receptacles being of a length at least the width of the belt, said receptacles being positioned adjacent to each other to provide a substantially flat surface under said belt with a substantially air-tight seal between the receptacles at the top, said receptacles having openings at the top communicating with the underside of the belt, said hood being positioned above the flat-top receptacles to form a substantially air-tight compartment over the portion of the belt and the receptacles, means to restrict the passageways between the belt and the hood at the entrance of the belt to the hood and at the exit from the hood, a plurality of wash liquid discharge means positioned above the belt transversally to the direction of the movement of the belt in the hood and spaced apart from each other to discharge wash liquid on top of the pulp on the belt, means to introduce wash liquid into the discharge means, means to withdraw gases and vapors from the upper portion of the flat-top receptacles and to recycle a portion of the gases and vapors to the hood compartment to provide a sufficient pressure differential between the compartment of the hood and the flat-top receptacles to force the spent pulping liquid from the pulp slurry and the wash liquid discharged on the pulp into the receptacles, means to withdraw liquid from the lower portion of the receptacles to control the liquid level in the receptacles, and means to convey the wash liquid withdrawn from the receptacles progressively to the liquid discharge means in the hood to discharge the wash liquid successively on the pulp a plurality of times.

4. A wood pulp washer comprising a movable foraminous belt positioned on a series of rolls including a drive roll and an end roll with at least a portion of the upper loop of the foraminous belt being substantially horizontally disposed, means to drive the drive roll to move the belt in a particular direction at variable speeds, a headbox positioned over the belt at one end to distribute a slurry of wood pulp in spent pulping liquor on said moving foraminous belt, a removable multi-compartment hood positioned over a portion of the upper loop of the belt, a plurality of flat-top receptacles positioned horizontally under the portion of the upper loop of the foraminous belt covered by the hood, said receptacles being positioned adjacent to each other to provide a substantially flat surface under said belt with a substantially air-tight seal between the receptacles at the top, said receptacles having openings at the top communicating with the underside of the belt, said hood being positioned over the belt and flat-top receptacles with a substantially air-tight seal between the flat-top receptacles and sides of the hood, means to restrict the passageways between the belt and partitions of the hood forming the compartments in the hood to have particular flat-top receptacles communicate with particular compartments of the hood, means to restrict the passageways between the belt and the hood at the entrance of the belt to the hood and at the exit from the hood, a plurality of wash liquid discharge means positioned above the belt transversally to the direction of the movement of the belt in the hood and spaced apart from each other to discharge wash liquid on top of the pulp on the belt, means to introduce wash liquid into the discharge means, means to withdraw gases and vapors from the flat-top receptacles, means to provide a sufficient pressure differential between the pressure in each compartment of the hood and the pressure in the flat-top receptacles communicating with the compartment to force the spent pulping liquid from the pulp slurry and the wash liquid discharged on the pulp into the receptacles, means to withdraw liquid from the receptacles to control the liquid level in the receptacles, and means to convey the wash liquid withdrawn from the receptacles progressively to the liquid discharge means in the hood to discharge the wash liquid successively on the pulp a plurality of times.

5. A wood pulp washer comprising a movable foraminous belt positioned on a series of rolls including a drive roll and an end roll with at least a portion of the upper loop of the foraminous belt being substantially horizontally disposed, means to drive the drive roll to move the belt in a particular direction at variable speeds, a headbox positioned over the belt at one end to distribute a slurry of wood pulp in spent pulping liquor on said moving foraminous belt, a removable hood positioned over a portion of the upper loop of the belt, a plurality of flat-top receptacles positioned horizontally under the upper loop of the foraminous belt covered by the hood, said receptacles being of a length exceeding the width of the belt with at least one end of said receptacles extending beyond the width of the hood, said receptacles being positioned adjacent to each other to provide a substantially flat surface under said belt with a substantially air-tight seal between the receptacles at the top, said receptacles having openings at the top communicating with the underside of the belt, said hood being positioned over the belt and the flat-top receptacles with the sides of the hood forming a substantially air-tight seal with the flat-top receptacles to form a compartment over the portion of the belt and the receptacles, means to restrict the passageways between the belt and the hood at the entrance of the belt to the hood and at the exit from the hood, a plurality of wash liquid discharge means positioned above the belt transversally to the direction of the movement of the belt in the hood and spaced apart from each other to discharge a plurality of sheets of wash liquid on top of the pulp on the belt, means to withdraw gases and vapors from the upper portion of the end of the flat-top receptacles extending beyond the hood and to recycle a sufficient portion of the gases and vapors to the hood compartment to provide a pressure differential between the compartment of the hood and the flat-top receptacles to force the spent pulping liquid from the pulp slurry and the wash liquid discharged on the pulp into the receptacles, means to withdraw liquid from the lower portion of the end of the flat-top receptacles extending beyond the hood to control the liquid level in the receptacles, means to introduce a fresh wash liquid into the discharge means in the hood most distant from the headbox to discharge the fresh wash liquid on the pulp on the belt, and means to convey the wash liquid withdrawn from the receptacles countercurrently in reference to the direction of movement of the belt to succeeding liquid discharge means in the hood to discharge the liquid on the pulp mat again until the pulp is contacted with the liquid discharged from the discharge means closest to the headbox.

6. A wood pulp washer according to claim 5 wherein the means to withdraw the gases and vapors withdraws the gases and vapors from the tops of the flat-top receptacles and the means to withdraw liquid withdraws the liquid from the bottoms of the flat-top receptacles.

7. A wood pulp washer comprising a movable foraminous belt positioned on a series of rolls including a drive roll and an end roll with at least a portion of the upper loop of the foraminous belt being substantially horizontally disposed, means to drive the drive roll to move the belt in a particular direction at variable speeds, a headbox positioned over the belt at one end to distribute a slurry of wood pulp in spent pulping liquid on said moving belt, a multi-compartment, removable hood positioned over a portion of the upper loop of the belt, a plurality of flat-top receptacles positioned horizontally under the upper loop of the belt the length of said receptacles exceeding the width of the belt to have the ends of the receptacles extend beyond the sides of the belt, said receptacles being positioned adjacent to each other to provide a substantially flat surface under said belt with a substantially air-tight seal between the receptacles at the top and said receptacles communicating with the underside of the belt through openings in the top of receptacles, said multi-compartment hood being positioned on the receptacles enclosing the headbox and the portion of the belt above the flat-top receptacles with the sides of the hood forming a substantially air-tight seal between the sides of the hood and the top of the flat-top receptacles, means to seal the passageways between the belt and the partitions of the hood to have particular flat-top receptacles communicate with particular compartments of the hood, means to seal the passageways between the belt and ends of the hood at the entrance of the foraminous belt to the hood and at the exit of the belt from the hood, a plurality of wash liquid discharge boxes positioned above the belt transversally to the direction of the movement of the belt in the hood, said discharge boxes being spaced apart from each other and each having means to discharge a uniform sheet of wash liquid on top of the pulp on the belt, means to introduce wash liquid into the discharge boxes in the hood, means to withdraw gases and vapors from the upper portion of the flat-top receptacles extending beyond the side of the belt, means to recycle a sufficient portion of the gases and vapors withdrawn from each receptacle to the hood compartment communicating with the receptacle to provide a predetermined pressure differential between the pressure in each compartment of the hood and the pressure in the flat-top receptacles communicating with the compartment to force into the receptacles the spent pulping liquid from the pulp slurry and the wash liquid discharged on the pulp from the discharge boxes, means to withdraw liquid from the lower portion of the receptacles extending beyond the side of the belt to control the liquid level in the receptacles, and means to convey the wash liquid withdrawn from the receptacles progressively to the discharge boxes in the hood to discharge the wash liquid successively on the pulp mat a plurality of times.

8. A wood pulp washer according to claim 7 wherein said means to introduce wash liquid into the discharge boxes comprises means to introduce fresh wash liquid into the discharge box in the hood most distant from the headbox, and said means to convey the wash liquid withdrawn from the receptacles progressively to the discharge boxes in the hood comprises means to convey the wash liquid withdrawn from the receptacles countercurrently in reference to the direction of movement of the belt to succeeding liquid discharge boxes in the hood to have the wash liquid discharged on the pulp again until the pulp mat is contacted with the wash liquid discharged from the discharge box closest to the headbox.

9. A wood pulp washer according to claim 7 wherein the hood has two compartments and a sufficient portion of the gas and vapors from each compartment drawn into the receptacles communicating with the compartment being recycled by being returned to the compartment to control the pressure and atmosphere in each compartment.

10. A wood pulp washer according to claim 8 wherein the hood has three compartments and a sufficient portion of the gases and vapors from each compartment drawn into the receptacles communicating with the compartment being recycled by being returned to the compartment to control the pressure and atmosphere in each compartment.

11. A wood pulp washer according to claim 8 wherein more than one flat-top receptacle is positioned in relationship to each liquid discharge box in the hood to receive the liquid discharge from the discharge box.

12. A wood pulp washer according to claim 8 wherein the flat-top receptacles contain horizontal baffles to aid in separation of the gases and vapors from the liquid in the receptacles.

13. A wood pulp washer according to claim 8 including a liquid flooding box at the entrance of the formaninous belt to the hood positioned underneath the belt in close relationship to the headbox to flood the belt with liquid displacing the air in the openings of the belt.

14. A wood pulp washer according to claim 8 wherein a discharge box in the hood is positioned at each compartment partition in the hood and a sealing box at the discharge end of the hood to have a continuous stream of the liquid discharged from the discharge boxes and sealing box onto the pulp mat to form a liquid seal for gases and vapors between the pulp mat on the moving belt and the partitions and the exit of the hood.

15. A process for washing wood pulp obtained by digestion of wood chips in a digester with a pulping liquor which comprises discharging a slurry of wood pulp in spent pulping liquor from the digester to a header to uniformly distribute the slurry on a foraminous belt moving substantially horizontally in an enclosure, said slurry being discharged at a consistency of from 1 to 8 weight percent of pulp and at a rate such that the thickness of the pulp on the belt after dewatering is in the range of ½ to 6 inches, passing the belt at a velocity of from 10 to 300 feet per minute through the enclosure over a multiplicity of closed receptacles communicating with the underside of the belt, dewatering the pulp slurry on the moving belt of the spent pulping liquor, washing the pulp dewatered of spent pulping liquor countercurrently with a pre-determined amount of wash liquid by subjecting the pulp on the moving belt as it passes through the enclosure to a series of liquid flooding and dewatering steps, said flooding steps being obtained by discharging a sheet of liquid on top of the pulp, said dewatering steps being obtained by drawing into the receptacles liquid from the pulp, separating in the receptacle the liquid from gases and vapors drawn into the receptacle from the enclosure with the liquid, withdrawing the gases and vapors from the receptacles and recycling a sufficient portion of the gases and vapors to the enclosure to obtain a pressure differential between the enclosure and the receptacle in the range of 1 to 4 inches of mercury, controlling the level of the liquid in the receptacles at a level to provide sufficient area for the flow of gases and vapors in the receptacle above the liquid level by withdrawing the liquid from the receptacle at a controlled rate, passing the belt with the pulp from the enclosure, and removing the washed pulp from the moving belt, said countercurrent washing of the pulp being obtained by contacting the pulp on the moving belt in the enclosure with a pre-determined amount of wash liquid, dewatering the pulp of the wash liquid and using the wash liquid obtained in successive flooding and dewatering steps to contact the pulp on the belt more distant from the point of exit of the belt from the enclosure until the pulp just dewatered of spent pulping liquid is contacted.

16. A process according to claim 15 wherein the vapors and gases and the liquid drawn into the receptacles are passed in the receptacles transversally from the belt for a sufficient distance to enhance the separation of the vapors and gases from the liquid before withdrawing the vapor and gases and the liquid from the receptacles separately.

17. A process according to claim 16 wherein the enclosure is a multi-compartment enclosure with each compartment communicating with particular receptacles, and wherein the gases and vapors drawn from the receptacles communicating with each compartment are recycled to the respective compartment to control the pressure differential between the compartment and the receptacles communicating with the compartment.

18. A process according to claim 17 wherein the flow of the gases and vapors in the receptacles about the liquid is in the range of about 1 to 15 feet per second.

19. A process according to claim 17 wherein the multi-compartment enclosure contains three compartments with the passageways between the compartments and the pulp on the moving belt being sealed by a flowing sheet of liquid.

20. A process according to claim 17 wherein the discharge of liquid on the pulp to obtain the flowing sheet of liquid is a flooding of the pulp with wash liquid in the washing of the pulp.

21. A process according to claim 17 wherein the vapors and gases are recycled in each compartment in the multi-compartment enclosure to control the pressure in each compartment and to obtain in each compartment an atmosphere substantially in equilibrium with the liquid in the compartment.

* * * * *

UNITED STATES PATENT OFFICE

CERTIFICATE OF CORRECTION

PATENT NO. : 4,154,644

DATED : May 15, 1979

INVENTOR(S) : Eric O. Ericsson

It is certified that error appears in the above-identified patent and that said Letters Patent are hereby corrected as shown below:

Column 14, line 22, to the end of the line after the word "to", insert -- move --.

Signed and Sealed this

*Twenty-first* Day of *August 1979*

[SEAL]

*Attest:*

*Attesting Officer*

LUTRELLE F. PARKER

*Acting Commissioner of Patents and Trademarks*